US006505486B1

(12) United States Patent
Chang

(10) Patent No.: US 6,505,486 B1
(45) Date of Patent: Jan. 14, 2003

(54) CLOTH DYEING MACHINE

(76) Inventor: Chi-Lung Chang, No. 9, Lane 219, Sec. 3, Chang-Hsing Rd., Lu-Chu Hsiang, Taoyuan County (CN)

( * ) Notice: Subject to any disclaimer, the term of this patent is extended or adjusted under 35 U.S.C. 154(b) by 147 days.

(21) Appl. No.: 09/593,189

(22) Filed: Jun. 14, 2000

(51) Int. Cl.[7] ..... D06B 3/24
(52) U.S. Cl. ..... 68/178; 68/184
(58) Field of Search ..... 68/177, 178, 184

(56) References Cited

U.S. PATENT DOCUMENTS 3,659,438 A * 5/1972 Chiba et al.
3,670,531 A * 6/1972 Thies et al.
3,679,357 A * 7/1972 Christ et al.
3,685,325 A * 8/1972 Carpenter
3,771,337 A * 11/1973 Trullas
3,982,411 A * 9/1976 Kreitz
4,083,207 A * 4/1978 Ekstroem
4,114,407 A * 9/1978 Turner et al.
4,142,385 A * 3/1979 Sandberg et al.
4,314,464 A * 2/1982 Gran
4,360,937 A * 11/1982 Putnam
4,392,365 A * 7/1983 Miyamoto et al.
4,570,464 A * 2/1986 Thompson
4,716,744 A * 1/1988 Turner et al.
4,873,847 A * 10/1989 Kasai et al.
5,014,525 A * 5/1991 Bene
5,129,242 A * 7/1992 Sturkey et al.
5,243,840 A * 9/1993 Grafen et al.
5,566,559 A * 10/1996 Chen
5,621,937 A * 4/1997 Georgants
5,775,136 A * 7/1998 Chao-Cheng
5,850,651 A * 12/1998 Ishimaru et al.
5,894,747 A * 4/1999 Abernathy et al.

* cited by examiner

*Primary Examiner*—Frankie L. Stinson
(74) *Attorney, Agent, or Firm*—Ladas & Parry

(57) ABSTRACT

A cloth dyeing machine includes a machine base defining a cylindrical dyeing bath, a cloth guide tube through which an inserted piece of cloth is circulated in the dyeing bath and dyed, a plurality of jet nozzles suspended in the dyeing bath in front of the cloth guide tube and controlled to eject jets of liquid coloring matter onto the piece of cloth when the piece of cloth is guided into the cloth guide tube, wherein the cloth guide tube has a curved front section curving downwards from the jet nozzles for guiding in the piece of cloth, enabling the piece of cloth to be vibrated and spread out by the force of the jets of liquid coloring matter.

1 Claim, 2 Drawing Sheets

CLOTH DYEING MACHINE

BACKGROUND OF THE INVENTION

The present invention relates to cloth dyeing machines, and more particularly to such a cloth dyeing machine in which the cloth guide tube which guides the inserted piece of cloth from jet nozzles toward the dyeing bath has a front section curving downwards from the jet nozzles for guiding in the piece of cloth, enabling the piece of cloth to be vibrated and spread out.

A regular cloth dyeing machine is generally comprised of a machine base defining a cylindrical dyeing bath holding a liquid coloring matter, a cloth guide tube horizontally mounted in the dyeing bath at the top, a plurality of jet nozzles suspending in the cylindrical dyeing bath in front of the cloth guide tube, a cloth guide roller disposed in front of the jet nozzles, and a motor drive controlled to turn the cloth guide roller. When the motor drive is started, the cloth guide roller is rotated to deliver the inserted piece of cloth, causing the piece of cloth to be circulated through the jet nozzles, the cloth guide tube and the dyeing bath. Because the cloth guide tube is mounted in the dyeing bath in horizontal, the piece of cloth may be wrinkled when delivered through the cloth guide tube.

SUMMARY OF THE INVENTION

The present invention has been accomplished to provide a cloth dyeing machine which eliminates the aforesaid problem. It is one object of the present invention to provide a cloth dyeing machine which keeps the piece of cloth fully spread out when circulating the piece of cloth in the dyeing bath. It is another object of the present invention to provide a cloth dyeing machine which prevents the piece of cloth from being wrinkled when dyeing. It is another object of the present invention to provide a cloth dyeing machine which achieves a satisfactory dyeing effect.

According to the present invention, the cloth dyeing machine comprises a machine base defining a cylindrical dyeing bath, a cloth guide tube through which an inserted piece of cloth is circulated in the dyeing bath and dyed, a plurality of jet nozzles suspended in the dyeing bath in front of the cloth guide tube and controlled to eject jets of liquid coloring matter onto the piece of cloth when the piece of cloth is guided into the cloth guide tube, wherein the cloth guide tube has a curved front section curving downwards from the jet nozzles for guiding in the piece of cloth, enabling the piece of cloth to be vibrated and spread out by the force of the jets of liquid coloring matter.

DETAILED DESCRIPTION OF THE PREFERRED EMBODIMENT

Figure 1:
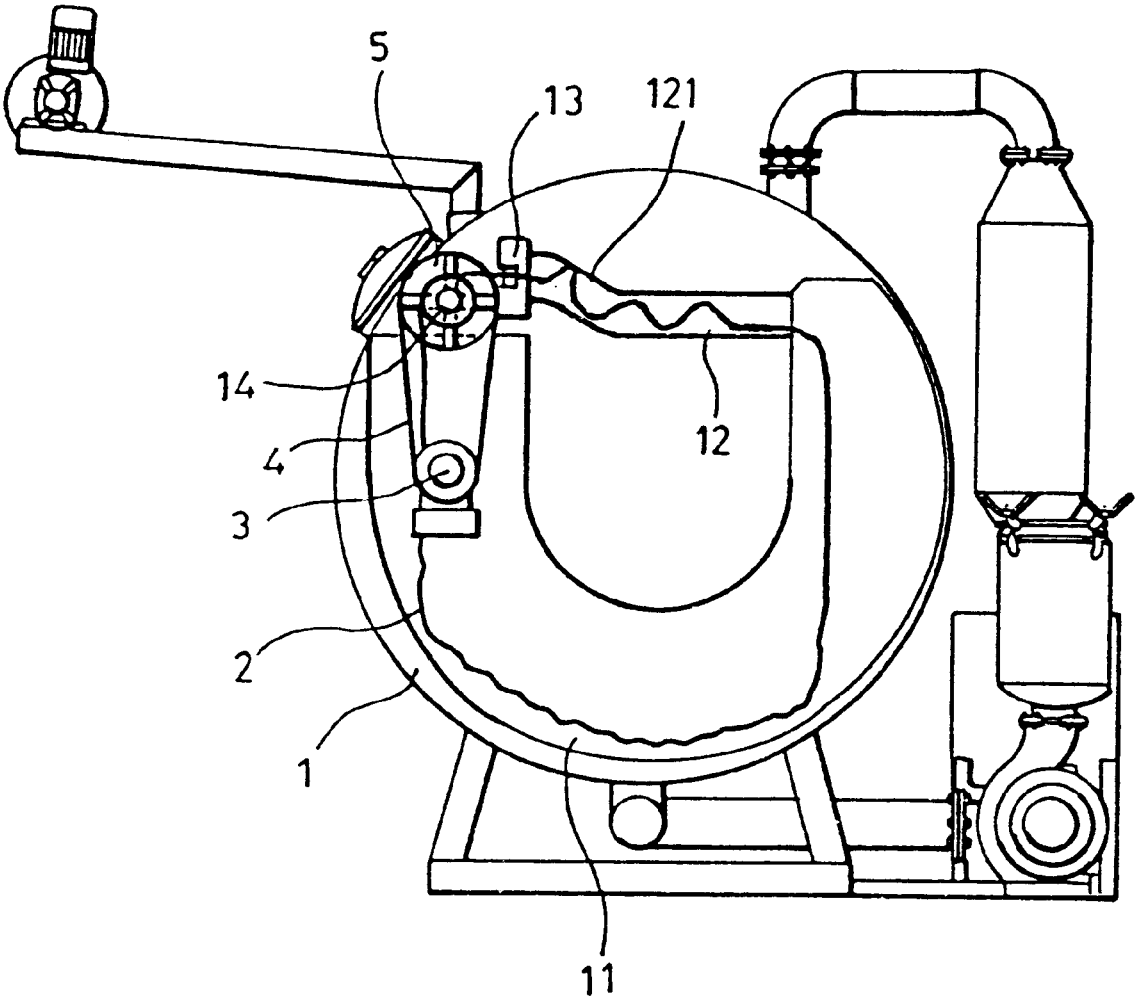
FIG. 1 is a sectional plain view of a cloth dyeing machine according to the present invention.
Figure 2:
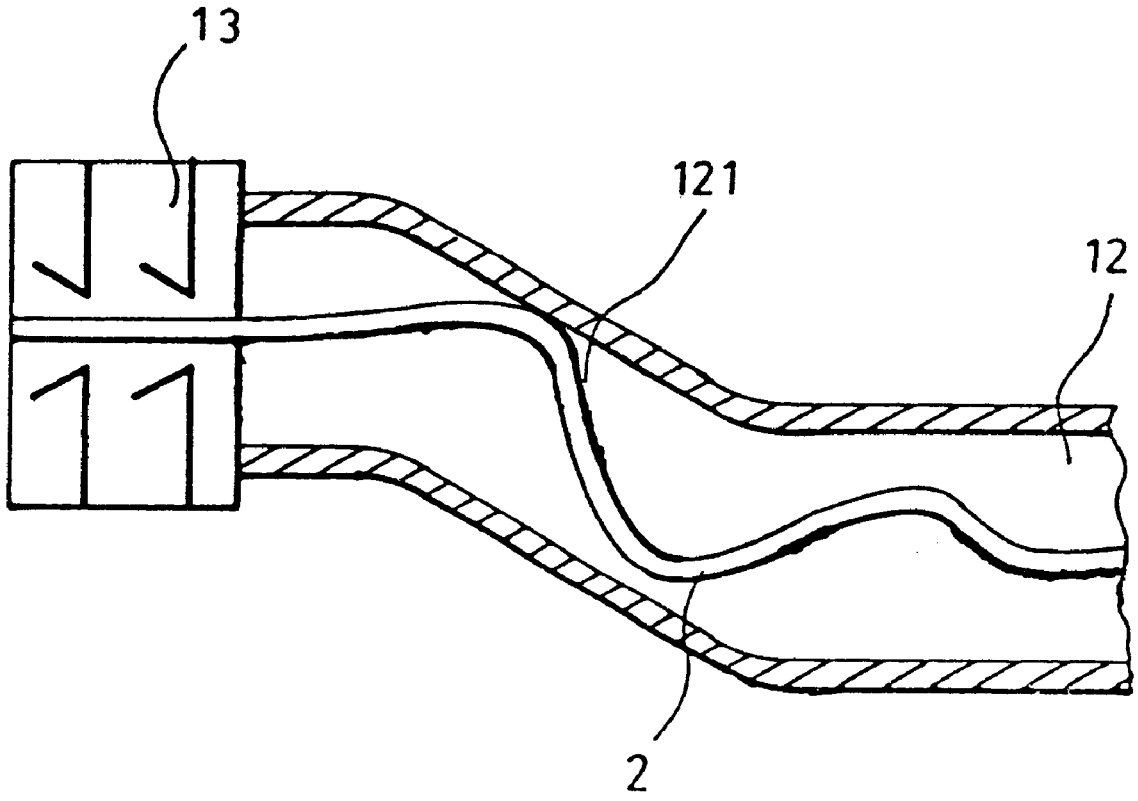
FIG. 2 is an enlarged view of a part of FIG. 1, showing the curved front section of the cloth guide tube curving downwards from the jet nozzles.

Referring to FIGS. 1 and 2, a cloth dyeing machine in accordance with the present invention is generally comprised of a machine base 1 defining a cylindrical dyeing bath 11 holding a liquid coloring matter, a cloth guide tube 12 mounted in the cylindrical dyeing bath 11, a plurality of jet nozzles 13 suspending in the cylindrical dyeing bath 11 at a top side at one end of the cloth guide tube 12, a cloth guide roller 14 disposed in front of the jet nozzles 13, a belt wheel 5 coupled to the cloth guide roller 14, a motor drive 3, a transmission belt 4 coupled between the motor drive 3 and the belt wheel 5. When the motor drive 3 is started, the transmission belt 4 is driven to turn the belt wheel 5, thereby causing the cloth guide roller 14 to be synchronously rotated.

Referring to FIGS. 1 and 2 again, when a piece of cloth 2 is delivered into the machine base 1, it is continuously guided forwards by the cloth guide roller 14, and circulated through the cloth guide tube 12. The cloth guide tube 12 has a curved front section 121 curving downwards from the jet nozzles 13 for guiding in the piece of cloth 2. When passing through the jet nozzles 13, the piece of cloth 2 is dyed by a liquid coloring matter driven out of the jet nozzles 13, and forced by the high pressure liquid coloring matter to vibrate and to spread out in the curved front section 121 of the cloth guide tube 12. Therefore, a satisfactory dyeing effect is achieved.

It is to be understood that the drawings are designed for purposes of illustration only, and are not intended as a definition of the limits and scope of the invention disclosed.

What the invention claimed is:

1. A cloth dyeing machine comprising a machine base defining a cylindrical dyeing bath, a cloth guide tube through which an inserted piece of cloth is circulated in said dyeing bath and dyed, a plurality of jet nozzles suspended in said dyeing bath in front of said cloth guide tube and controlled to eject jets of liquid coloring matter onto the piece of cloth when the piece of cloth is guided into said cloth guide tube, wherein said cloth guide tube has a curved front section curving downwards from said jet nozzles for guiding in the piece of cloth, enabling the piece of cloth to be vibrated and spread out by the force of the jets of liquid coloring matter.

* * * * *